US010590954B2

(12) United States Patent
Binyuan et al.

(10) Patent No.: US 10,590,954 B2
(45) Date of Patent: Mar. 17, 2020

(54) FLAT FLOW-CONDUCTING GRILLE

(71) Applicant: ebm-papst Mulfingen GmbH & Co. KG, Mulfingen (DE)

(72) Inventors: Zhang Binyuan, Dörzbach (DE); Christian Haag, Künzelsau (DE); Carsten Hübner, Hessental (DE); Björn Sudler, Boxberg (DE); Manuel Vogel, Jagsthausen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 179 days.

(21) Appl. No.: 15/569,452

(22) PCT Filed: May 19, 2016

(86) PCT No.: PCT/EP2016/061284
§ 371 (c)(1),
(2) Date: Oct. 26, 2017

(87) PCT Pub. No.: WO2016/184970
PCT Pub. Date: Nov. 24, 2016

(65) Prior Publication Data

US 2018/0298916 A1 Oct. 18, 2018

(30) Foreign Application Priority Data

May 20, 2015 (DE) ..... 10 2015 107 907

(51) Int. Cl.
*F04D 29/42* (2006.01)
*F04D 29/54* (2006.01)
(Continued)

(52) U.S. Cl.
CPC ..... *F04D 29/541* (2013.01); *F04D 29/4213* (2013.01); *F04D 29/444* (2013.01);
(Continued)

(58) Field of Classification Search
CPC .... F04D 29/541; F04D 29/444; F04D 29/663; F04D 29/703; F05D 2250/51
See application file for complete search history.

(56) References Cited

U.S. PATENT DOCUMENTS 1,931,692 A * 10/1933 Good ..... F04D 29/023 415/191
2,305,136 A 12/1942 Campbell
(Continued)

FOREIGN PATENT DOCUMENTS

| | | | |
|---|---|---|---|
| DE | 1052624 | B | 3/1959 |
| DE | 102014116047 | A1 | 5/2016 |
| EP | 2778432 | A1 | 9/2014 |

OTHER PUBLICATIONS

International Search Report (in German with English Translation) for PCT/EP2016/061284, dated Jul. 12, 2016; ISA/EP.

*Primary Examiner* — Moshe Wilensky
*Assistant Examiner* — Theodore C Ribadeneyra
(74) *Attorney, Agent, or Firm* — Harness, Dickey & Pierce, P.L.C.

(57) ABSTRACT

The invention relates to a flow-conducting grille designed as a pre-conducting grille for arranging on a suction region of a fan, wherein the flow-conducting grille has a grille web structure about an axial center line, which grille web structure comprises radial webs spaced apart in the circumferential direction and coaxial circumferential webs spaced apart in the radial direction and an outer ring, wherein an inflow side of the flow-conducting grille extends flat and parallel to a radial plane of the flow-conducting grille.

14 Claims, 4 Drawing Sheets

(51) Int. Cl.
*F04D 29/70* (2006.01)
*F04D 29/44* (2006.01)
*F04D 29/66* (2006.01)

(52) U.S. Cl.
CPC ..... *F04D 29/663* (2013.01); *F04D 29/703* (2013.01); *F05D 2250/51* (2013.01)

(56) References Cited

U.S. PATENT DOCUMENTS 4,695,225 A * 9/1987 Hellat ..... F15D 1/0015 239/486
5,466,120 A 11/1995 Takeuchi et al.
5,951,245 A * 9/1999 Sullivan ..... F04D 29/681 415/121.2
6,139,265 A * 10/2000 Alizadeh ..... F04D 29/544 415/208.1
6,503,060 B1 * 1/2003 Kannada ..... F04D 29/703 415/121.2
8,845,268 B2 * 9/2014 Nikpour ..... F04D 17/025 415/143
9,618,007 B2 * 4/2017 Iyer ..... F04D 29/245
9,850,913 B2 * 12/2017 An ..... F04D 29/4213
2005/0191955 A1 * 9/2005 Horng ..... F04D 29/667 454/184
2005/0260068 A1 * 11/2005 Marchese ..... F04D 29/4213 415/182.1
2009/0092499 A1 * 4/2009 Barker ..... F04D 29/667 416/247 R
2012/0014788 A1 * 1/2012 Blair ..... F04D 29/444 415/208.2
2013/0202426 A1 * 8/2013 Walker ..... F04D 29/4286 415/203
2013/0224004 A1 * 8/2013 Radhakrishnan ..... F04D 29/444 415/191
2014/0141708 A1 5/2014 Baker
2014/0205450 A1 * 7/2014 Cocks ..... F04D 17/16 415/213.1
2014/0209275 A1 7/2014 Schone et al.
2014/0271170 A1 * 9/2014 Holbrook ..... F04D 29/30 415/208.3
2015/0086326 A1 * 3/2015 Husted ..... F04D 27/0284 415/1
2015/0275918 A1 * 10/2015 Hausmann ..... F04D 29/542 415/1
2016/0053774 A1 * 2/2016 Tarnowski ..... F04D 29/444 415/207
2016/0281732 A1 * 9/2016 Lardy ..... F04D 29/30
2017/0248153 A1 * 8/2017 Park ..... F24F 11/89

* cited by examiner

FLAT FLOW-CONDUCTING GRILLE

CROSS REFERENCE TO RELATED APPLICATIONS

This application is a U.S. National Phase Application under 35 U.S.C. 371 of International Application No. PCT/EP2016/061284 filed on May 19, 2016 and published in German as WO 2016/184970 A1 on Nov. 24, 2016. This application claims priority to German Application No. 10 2015 107 907.0 filed on May 20, 2015. The entire disclosures of all of the above applications are incorporated herein by reference.

DESCRIPTION

The invention relates to a flow-conducting grille designed as a pre-conducting grille for arranging on a suction region of a fan.

From the prior art, pre-conducting grilles in different designs and variants are known, in particular with curved shape or in the form of a spherical cap. Corresponding disclosures are found in the patent applications DE 10 2014 116 047 A, EP 2 778 432 A1 or DE 1 052 624 B.

The flow-conducting grilles or flow-conducting rectifiers which trace back to the applicant and are known in the prior art function very well in practice, but, because they are curved in the axial direction, they require a certain installation space in order to function optimally. Therefore, in the case of limited installation conditions, the curved shape is not always advantageous.

The underlying aim of the invention therefore is to provide a flow-conducting grille which, in comparison to the solutions known from the prior art, has a small space requirement in the axial direction, wherein, at the same time, the performance capacity is at least maintained and noise generation is at least not increased. Furthermore, the aim of the invention is to develop a fan having a corresponding flow-conducting grille so as to form a compact structural unit.

These aims are achieved by the combinations of features of the respective independent claims.

Proposed according to the invention is a flow-conducting grille designed as a pre-conducting grille for arranging on a suction region of a fan, flow-conducting grille which has a grille web structure about an axial center line, which grille web structure comprises radial webs spaced apart in the circumferential direction and coaxial circumferential webs which are spaced apart in the radial direction and an outer ring. Here, in the flow-conducting grille, the inflow side extends flat and parallel to one of the radial planes thereof. The flat, planar extent enables a utilization of turbulence minimization in the suction region on the inflow side of the flow-conducting grille, even in the case of limited installation conditions.

To achieve a further reduction of the axial installation space required, it is provided, in a design of the invention, that the flow-conducting grille is designed flat and the ratio of the maximum outer diameter $D_3$ thereof (clear width) to the total axial height H thereof is defined to be in a range of 6-25, preferably 10-15. The flat geometry in the value range mentioned leads to small installation heights of the flow-conducting grille on the fan and promotes a compact overall structure.

In an advantageous embodiment variant, it is provided that, in a central region of the flow-conducting grille, about an axial center line thereof, a central opening with an inflow-side central diameter $D_1$ is formed, wherein the ratio of the central diameter $D_1$ with respect to a maximum outer diameter $D_3$ of the flow-conducting grille (clear width) is defined to be in a range of 1.5-6.0, preferably 2.0-2.5. The central opening is delimited radially outward by the first circumferential web and offers the possibility of arranging components of the connected fan in the region of the flow-conducting grille, so that, for example, the rotor housing extends axially into the flow-conducting grille and thus minimizes the axial assembly height of the fan together with the flow-conducting grille.

Furthermore, in a development of the invention, it is provided that the first coaxial circumferential web viewed in the radial outward direction has an extent from the inflow side to an outflow side, which is inclined radially outward with respect to the axial center line by an angle $\alpha$. In an advantageous embodiment, the second coaxial circumferential web viewed in the radial outward direction has an extent from the inflow side to an outflow side, which is inclined radially inward with respect to the axial center line by an angle $\beta$.

The extents of the first and second coaxial circumferential webs viewed in the radial outward direction form, in an imaginary extension of the axial end points thereof, at a spacing L from the inflow side, an intersection point, which determines an intersection point diameter $D_4$ radially spaced apart with respect to the radial center line, i.e., the circumferential webs are oriented with respect to one another in such a manner that the imaginary extensions of a line connecting their respective end points intersect in a plane axially spaced apart from the flow-conducting grille. The circumferential webs which are facing one another generate an advantageous flow for fan performance and noise generation at a predetermined radial spacing from the axial center line.

In another advantageous development of the invention, the flow-conducting grille is characterized in that a ratio of the intersection point diameter $D_4$ with respect to an outflow-side outer diameter $D_3$ of the flow-conducting grille is defined to be in a range of 0.01-0.8. According to the invention, as an additional advantageous ratio, the intersection point diameter $D_4$ with respect to the axial spacing of the intersection point L is defined to be in a range of 0-1.6. In addition, according to the invention, in an embodiment variant, the ratio of the axial height H of the flow-conducting grille with respect to the axial spacing of the intersection point L is defined to be in a range of 0.01-0.5. The ratios according to the invention ensure the inflow and the through flow of the air suctioned by the fan to and through the flat flow-conducting grille with a noise generation which is not increased in comparison to curved designs.

In the flow-conducting grille according to the invention, in an advantageous embodiment, it is provided moreover that the first and second coaxial circumferential webs viewed in the radial direction each have an axial extent H1, H2 parallel to the axial center line, the ratio of which with respect to the axial height H is defined to be H1<H2<H. The axial extent of the radial webs increases over the respective radial length from the first circumferential web to the outer ring.

The first and second coaxial circumferential webs viewed in the radial direction are designed to be curved, advantageously convexly in the direction of the axial center line. Here, the shape of the circumferential webs has a direct positive effect on the flow in the axial direction.

Furthermore, in terms of flow technology, it is advantageous for the flow-conducting grille to have a large number of radial webs respectively spaced apart by a circumferential angle δ of 0-20°, preferably 15°. The number of the radial webs is a factor influencing both the performance of the flow-conducting grille and the noise generated by the use thereof.

In an advantageous variant of the invention, the grille structure of the flow-conducting grille has a geometry in which, in an axial top view from the inflow side, between respective adjacent radial webs and between the first and second coaxial circumferential webs viewed in the radial direction, grille meshes having a first diagonal extent $L_1$ are formed, and, between respective adjacent radial webs and between the second coaxial circumferential web viewed in the radial direction and the outer ring, respective grille meshes having a second diagonal extent $L_2$ are formed, wherein a ratio of the diagonal extents $L_1<L_2$ is defined.

With regard to the outflow side, it is advantageous according to the invention, that, in an axial top view, between respective adjacent radial webs and between the first and second coaxial circumferential webs viewed in the radial direction, grille meshes having a first diagonal extent ($L_3$) are formed, and, between respective adjacent radial webs and between the second coaxial circumferential web viewed in the radial direction and the outer ring, respective grille meshes having a second diagonal extent ($L_4$) are formed, wherein a ratio of the diagonal extents $L_3<L_4$ is defined. The geometry of the grille meshes according to the invention enables an increased flow in the radial outer region.

The invention also comprises a fan with a drive unit and an above-described flow-conducting grille which is characterized in that the drive unit extends at least in certain sections in the axial direction into a region of the flow-conducting grille, in order to ensure the compact design.

In a development, it is moreover provided that the ratio of the radial distance SPm between the radial outer edge of the drive unit and the outflow-side central diameter $D_2$ of the central opening and the inflow-side central diameter $D_1$ is defined to have a value less than or equal to 0.15.

Other advantageous developments of the invention are characterized in the dependent claims or described in further detail below together with the description of the preferred design of the invention in reference to the figures.

Figure 1:
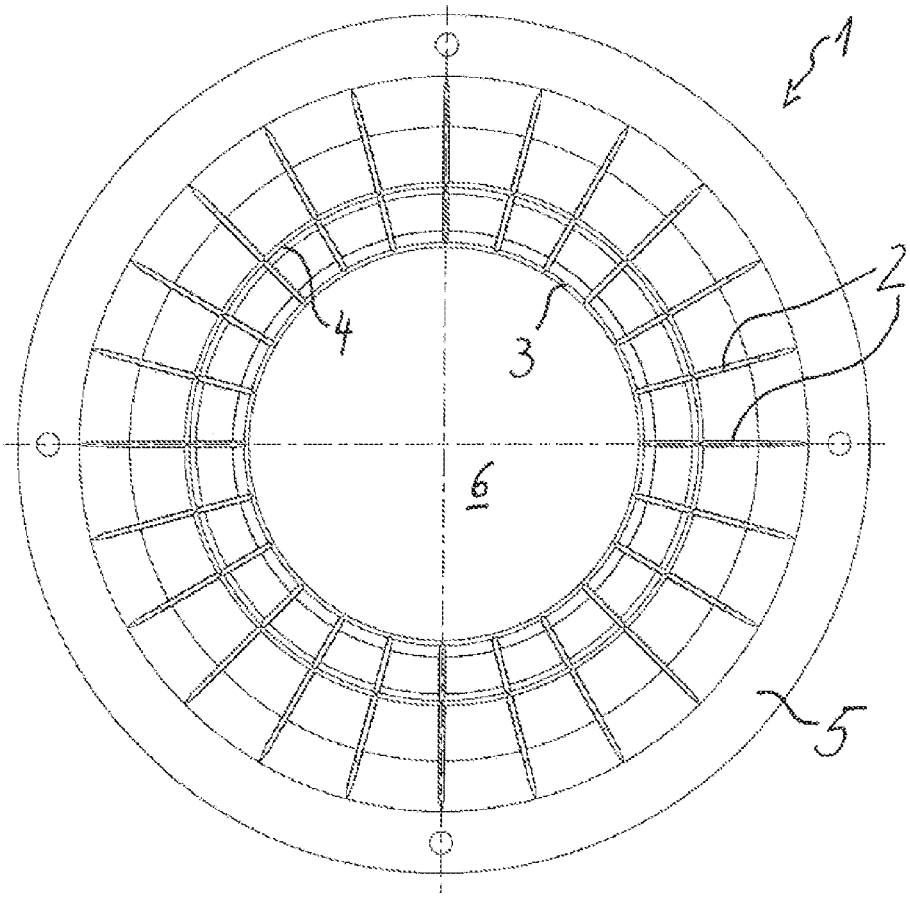
FIG. 1 shows a top view onto the inflow side of a flow-conducting grille.

In FIG. 1, a top view onto the inflow side of a flow-conducting grille 1 is shown. The flow-conducting grille 1 is designed as a pre-conducting grille for arranging on the suction region of a fan 50, as represented as an example in FIG. 5. About an axial center line ML, the flow-conducting grille 1 has a grille web structure with radial webs 2 spaced part in the circumferential direction and circumferential webs 3, 4 spaced apart in the radial direction and coaxially arranged and an outer ring 5 closing off the outer edge. In the central region about the axial center line ML, a central opening 6 delimited by the innermost radial web 3 is provided.

Figure 2:
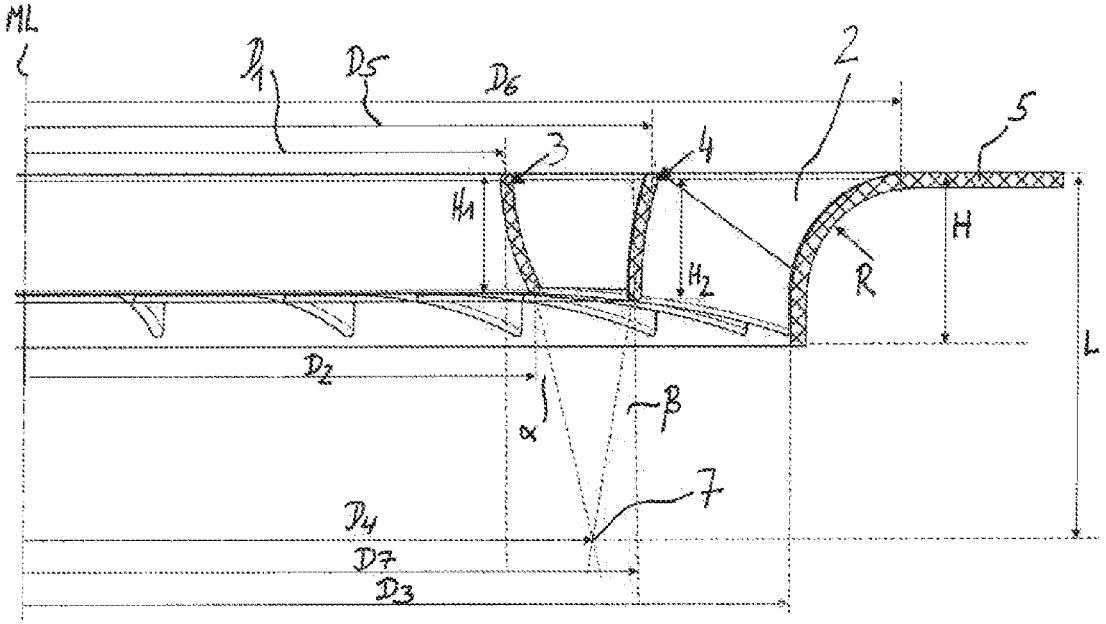
FIG. 2 shows a lateral cross-sectional view of half of the flow-conducting grille from FIG. 1.

FIG. 2 shows a lateral cross-sectional view of half of the flow-conducting grille 1 from FIG. 1. The inflow side of the flow-conducting grille 1, which is at the top in FIG. 2, is designed to be planar flat and extends parallel to the radial plane thereof, wherein all the elements of the flow-conducting grille 1, i.e., the outer ring 5, the radial webs 2, and the circumferential webs 3, 4, end in a radial plane of the inflow side. The outer ring 5 forms the radial and axial closure, wherein the transition is determined by a predetermined rounding R of R=10 mm, in the embodiment example. The radial webs 2 extend on the inflow side over a diameter $D_6$ and on the outflow side almost up to the outer ring 5 which, in this region, is determined by the diameter $D_3$. The circumferential webs 3, 4 extend on the inflow side in the radial direction over the diameters $D_1$, $D_5$ and on the outflow side over the diameters $D_2$, $D_7$. In the axial direction, the circumferential webs 3, 4 extend from the inflow side in the direction of the outflow side, curved convexly in the direction of the center line, wherein the radially inner circumferential web 3 has a curvature in the direction of the outflow side, and the circumferential web 4 has a curvature in the direction of the inflow side. Furthermore, the circumferential web 3 extends from the inflow side to the outflow side inclined radially outward with respect to the axial center line at an angle of α=18°. The radially farther outward circumferential web 4 extends from the inflow side to the outflow side inclined radially inward with respect to the axial center line at an angle of β=−12°, so that the circumferential webs 3, 4 form, in an imaginary extension at a spacing L from the inflow side, the intersection point 7. The intersection point 7 is radially spaced apart from the axial center line ML and extends in the circumferential direction at the intersection point diameter $D_4$. The axial height $H_1$ of the innermost circumferential web 3 is smaller than the axial height $H_2$ of the second circumferential web 4, which in turn is smaller than the total axial height H of the flow-conducting grille 1, which is determined by the outer ring 5 in the embodiment shown. The radial webs 2 are designed in such a manner that the axial height thereof, starting from the innermost circumferential web 3, increases in radial outward direction up to the outer ring 5.

In the flow-conducting grille 1 shown in FIGS. 1 and 2, the ratio of the maximum outer diameter $D_3$ to the axial height H assumes a value of 12.14. The ratio of the inflow-side central diameter $D_1$ with respect to the maximum outer diameter $D_3$ is 2.19. The ratio of the intersection point diameter $D_4$ with respect to the outflow-side outer diameter $D_3$ is defined to have a value of 0.74. The ratio of the intersection point diameter $D_4$ with respect to the spacing L from the inflow side assumes a value of 1.55. The ratio of the axial height H with respect to the spacing L from the inflow side is 0.47.

Figure 3:
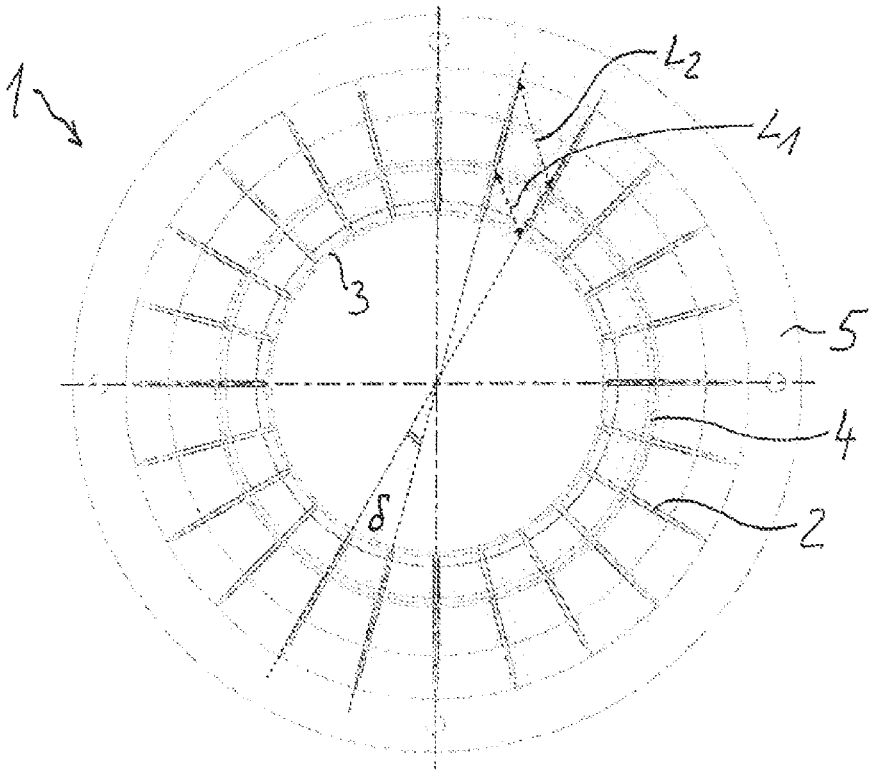
FIG. 3 shows a top view onto the inflow side of a flow-conducting grille.
Figure 4:
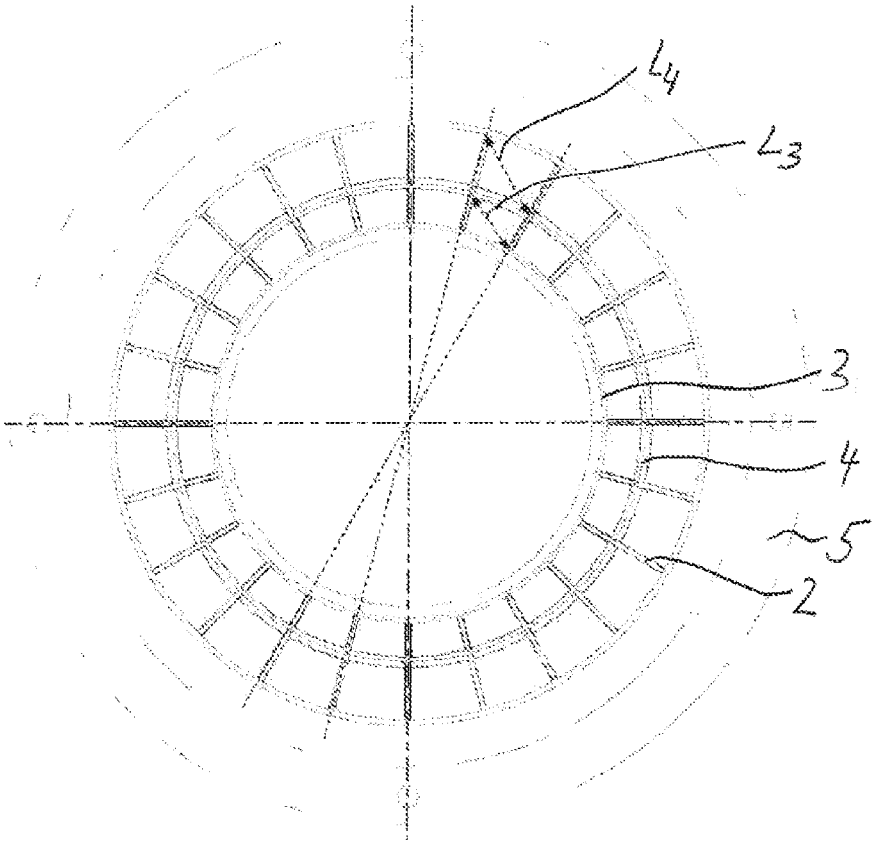
FIG. 4 shows a top view onto the outflow side of a flow-conducting grille.

FIGS. 3 and 4 each show a top view onto the inflow side or the outflow side of the flow-conducting grille 1 of FIGS. 1-2. The radial webs 2 are each spaced apart by a circumferential angle δ=15°, so that 24 radial webs 2 are provided in the embodiment example represented. The grille meshes determined by the radial webs 2 and circumferential webs 3, 4 each have a diagonal extent which is defined such that the radially farther outward grille meshes are larger both on the inflow side and on the outflow side. Therefore, the applicable ratio is $L_1<L_2$ on the inflow side and $L_3<L_4$ on the outflow side.

Figure 5:
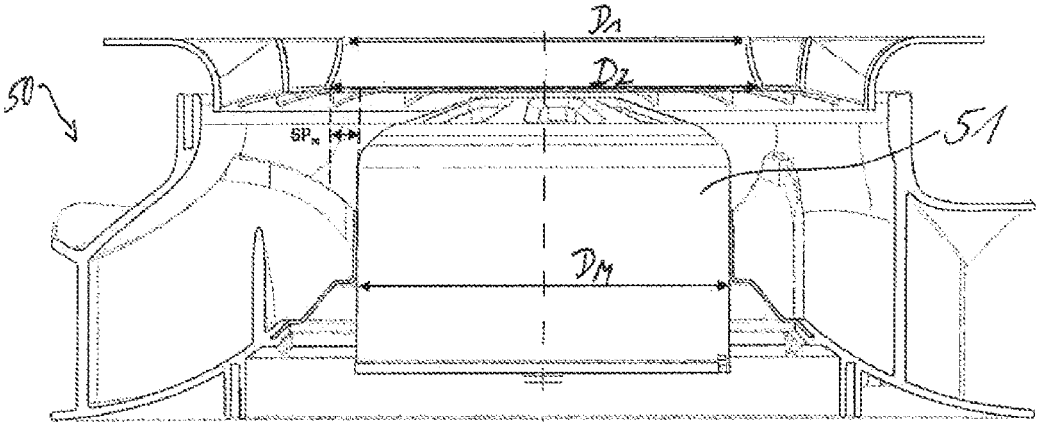
FIG. 5 shows an installation situation of the flow-conducting grille on a fan in a lateral view.

In FIG. 5, an installation situation of the flow-conducting grille 1 from FIG. 1 on a fan 50 is represented in a lateral view. The fan 50 comprises a motor, which comprises a rotor housing 51 having a diameter $D_M$. In the axial direction, the rotor housing 51 extends into the central opening 6 of the flow-conducting grille 1, but, radially, a radial distance SPm between the radial outer edge of the rotor housing 51 and the outflow-side central diameter $D_2$ of the central opening (which corresponds to the outflow-side diameter of the inner circumferential web 3) is provided. The ratio thereof to the inflow-side central diameter $D_1$ (which corresponds to the inflow-side diameter of the inner circumferential web 3) is defined to have a value 0.13.

Figure 6:
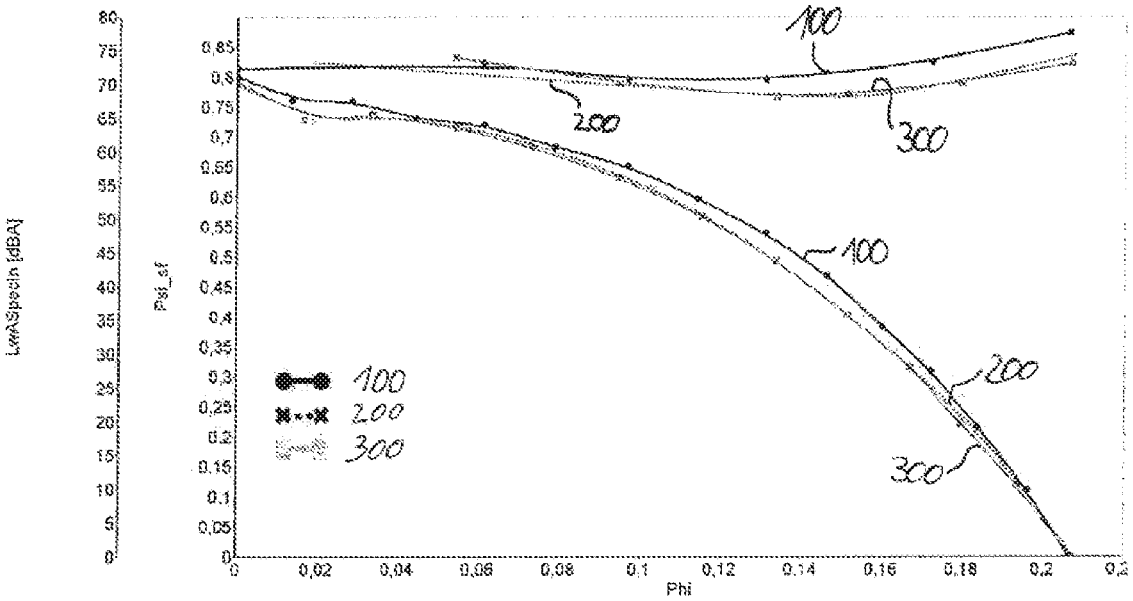
FIG. 6 shows a comparison of the characteristic curves of the flow-conducting grille according to the invention.

FIG. 6 shows a comparison of the characteristic curves, in each case using an inflow box, of the flow-conducting grille 1 according to the invention, wherein the characteristic curves of the flow-conducting grille of FIG. 1-4 are provided with reference numeral 200. By comparison, characteristic curves without flow-conducting grille are marked with reference numeral 100 and characteristic curves with a flow-conducting grille known from the prior art are marked with reference numeral 300. The positive effect of the flow-conducting grille 1 according to the invention with regard to noise reduction in dBA manifests itself particularly in flow coefficients (phi) of 0.04-0.1. The total pressure difference is particularly advantageous in the case of high flow coefficients.

The invention, in the embodiment thereof, is not limited to the above-indicated preferred embodiment examples. Instead, many variants which make use of the solution represented are conceivable, even in designs of fundamentally different type. For example, the number of the circumferential webs is not limited to two; rather any number of additional circumferential webs can be provided instead.

The invention claimed is:

1. A flow-conducting grille comprising a grille web structure about an axial center line, the grille web structure includes radial webs spaced apart in a circumferential direction, coaxial circumferential webs spaced apart in a radial direction and an outer ring, wherein the flow-conducting grille is designed flat and a ratio $D_3/H$ of a maximum outer diameter ($D_3$) thereof to an axial height (H) is defined to be in a range of 6-25, and an inflow side of the flow-conducting grille extends flat and parallel to a radial plane of the flow-conducting grille, a first coaxial circumferential web from the axial center line when viewed in the radial direction has an extent from an inflow side to an outflow side and is inclined radially outward with respect to the axial center line by an angle ($\alpha$), and a second coaxial circumferential web from the axial center line when viewed in the radial direction has an extent from the inflow side to the outflow side, and is inclined radially inward with respect to the axial center line by an angle ($\beta$).

2. The flow-conducting grille according to claim 1, wherein the flow-conducting grille is formed, in a central region, about the axial center line, with a central opening having an inflow-side central diameter ($D_1$), wherein a ratio with respect to the maximum outer diameter ($D_3$) of the flow-conducting grille is defined to be in a range of $D_3/D_1$=1.5-6.0.

3. The flow-conducting grille according to claim 1, wherein the extents of the first and second coaxial circumferential webs viewed in the radial direction form, in an imaginary extension at a spacing (L) from the inflow side, an intersection point, which determines an intersection point diameter ($D_4$) radially spaced apart with respect to the axial center line.

4. The flow-conducting grille according to claim 3, wherein a ratio $D_4/D_3$ of the intersection point diameter ($D_4$) with respect to an outflow-side outer diameter ($D_3$) of the flow-conducting grille is defined to be in a range of 0.01-0.8.

5. The flow-conducting grille according to claim 3, wherein a ratio $D_4/L$ of the intersection point diameter ($D_4$) with respect to the spacing (L) between the intersection point and the inflow side is defined to be in a range of 0-1.6.

6. The flow-conducting grille according to claim 3, wherein a ratio H/L of an axial height (H) of the flow-conducting grille with respect to the spacing (L) between the intersection point (7) and the inflow side is defined to be in a range of 0.01-0.5.

7. The flow-conducting grille according to claim 6, wherein the first and second coaxial circumferential webs viewed in the radial direction each have an axial extent ($H_1$, $H_2$) parallel to the axial center line, a ratio of which with respect to the axial height of the flow-conducting grille is defined to be $H_1<H_2<H$.

8. The flow-conducting grille according to claim 1, wherein the first and second coaxial webs viewed in the radial direction are designed to be curved convexly in the direction of the axial center line.

9. The flow-conducting grille according to claim 1, wherein the respective radial webs are spaced apart by a circumferential angle ($\delta$) of $\leq 20°$.

10. The flow-conducting grille according to claim 1, wherein in an axial top view from the inflow side, between respective adjacent radial webs and between the first and second coaxial circumferential webs viewed in the radial direction, grille meshes having a first diagonal extent ($L_1$) are formed, and, between respective adjacent radial webs and between the second coaxial circumferential web viewed in the radial direction and the outer ring (5), respective grille meshes having a second diagonal extent ($L_2$) are formed, wherein a length ratio $L_1<L_2$ is defined.

11. The flow-conducting grille according to claim 1, characterized in in that, in an axial top view from the outflow side, between respective adjacent radial webs and between the first and second coaxial circumferential webs viewed in the radial direction, grille meshes having a first diagonal extent ($L_3$) are formed, and, between respective adjacent radial webs and between the second coaxial circumferential web viewed in the radial direction and the outer ring (5), respective grille meshes having a second diagonal extent ($L_4$) are formed, wherein a length ratio $L_3<L_4$ is defined.

12. A fan having a drive unit as well as a flow-conducting grille according to claim 1, wherein the drive unit extends at least in certain sections in the axial direction into a region of the flow-conducting grille, and a ratio of a radial distance (SPm) between a radial outer edge of the drive unit and an outflow-side central diameter ($D_2$) of a central opening and an inflow-side central diameter ($D_1$) is defined to have a value $SPm/D_1 \leq 0.15$.

13. A flow-conducting grille comprising a grille web structure about an axial center line, the grille web structure includes radial webs spaced apart in a circumferential direction, coaxial circumferential webs spaced apart in a radial direction and an outer ring, wherein an inflow side of the flow-conducting grille extends flat and parallel to a radial plane of the flow-conducting grille, a first coaxial circumferential web from the axial center line when viewed in the radial direction has an extent from an inflow side to an outflow side and is inclined radially outward with respect to the axial center line by an angle ($\alpha$), a second coaxial circumferential web from the axial center line when viewed in the radial direction has an extent from the inflow side to the outflow side, and is inclined radially inward with respect to the axial center line by an angle ($\beta$), the extents of the first and second coaxial circumferential webs viewed in the radial direction form, in an imaginary extension at a spacing (L) from the inflow side, an intersection point, which determines an intersection point diameter ($D_4$) radially spaced apart with respect to the axial center line, a ratio $D_4/D_3$ of the intersection point diameter ($D_4$) with respect to an outflow-side outer diameter ($D_3$) of the flow-conducting grille is defined to be in a range of 0.01-0.8.

14. A flow-conducting grille comprising a grille web structure about an axial center line, the grille web structure includes radial webs spaced apart in a circumferential direction, coaxial circumferential webs spaced apart in a radial direction and an outer ring, wherein an inflow side of the flow-conducting grille extends flat and parallel to a radial plane of the flow-conducting grille, a first coaxial circumferential web from the axial center line when viewed in the radial direction has an extent from an inflow side to an outflow side and is inclined radially outward with respect to the axial center line by an angle ($\alpha$), a second coaxial circumferential web from the axial center line when viewed in the radial direction has an extent from the inflow side to the outflow side, and is inclined radially inward with respect to the axial center line by an angle ($\beta$), the extents of the first and second coaxial circumferential webs viewed in the radial direction form, in an imaginary extension at a spacing (L) from the inflow side, an intersection point, which determines an intersection point diameter ($D_4$) radially spaced apart with respect to the axial center line, and a ratio $D_4/L$ of the intersection point diameter ($D_4$) with respect to the spacing (L) between the intersection point and the inflow side is defined to be in a range of 0-1.6.

* * * * *